US010244799B2

(12) United States Patent
Bunn

(10) Patent No.: US 10,244,799 B2
(45) Date of Patent: Apr. 2, 2019

(54) SOCK STORAGE AND ORGANIZING APPARATUS

(71) Applicant: Kevin Bunn, Clayton, NC (US)

(72) Inventor: Kevin Bunn, Clayton, NC (US)

( * ) Notice: Subject to any disclaimer, the term of this patent is extended or adjusted under 35 U.S.C. 154(b) by 240 days.

(21) Appl. No.: 15/266,198

(22) Filed: Sep. 15, 2016

(65) Prior Publication Data

US 2018/0070651 A1 Mar. 15, 2018

(51) Int. Cl.
*A41B 11/00* (2006.01)

(52) U.S. Cl.
CPC ..... *A41B 11/002* (2013.01)

(58) Field of Classification Search
CPC ..... A41B 11/002; D06F 95/008
See application file for complete search history.

(56) References Cited

U.S. PATENT DOCUMENTS 2,953,828 A * 9/1960 Hochman ..... D06F 95/008 211/113
6,038,748 A 3/2000 Durney et al.
2014/0097214 A1* 4/2014 Schreckenhofer ..... A47G 25/48 223/85
2017/0356123 A1* 12/2017 Sopoliga ..... A47G 25/28

FOREIGN PATENT DOCUMENTS

CA 2934178 A1 * 12/2016 ..... A44B 13/02

* cited by examiner

*Primary Examiner* — Andrew W Sutton

(74) *Attorney, Agent, or Firm* — Williams Intellectual Property; Benjamin F. Williams

(57) ABSTRACT

A sock storage and organizing apparatus includes an attachment portion and a depending portion detachable therefrom. The depending portion includes a looped drawstring member dependable from the attachment portion. The looped drawstring presents an apex in contact with a hook member disposed upon the attachment portion, a pair of strands disposed in parallel therefrom, and a nadir terminally disposed distally relative the apex. Each of the pair of strands is strung through each of a plurality of slidable buckle members, each of which plurality of slidable buckle members is securably repositionable along the length of the looped drawstring member. Pairs of socks are thus securable between each of the pair of strands by selective position of an adjacent one of the plurality of slidable buckle members. A user may conveniently store socks for wear, and sequentially replace socks subsequent wear for laundering, ported, laundered, and maintained as a single unit.

9 Claims, 6 Drawing Sheets

SOCK STORAGE AND ORGANIZING APPARATUS

BACKGROUND OF THE INVENTION

Various types of sock storage apparatuses are known in the prior art. Most make use of furniture existing for additional purposes, such as bureaus and chests of drawers. Socks are thus typically stored loosely, or in disconnected pairs. After wear, socks are typically thrown in a laundry hamper or basket as individual items for laundering.

Loose socks can be problematic. Socks are frequently dropped during transport between storage locations and laundry facilities. Individual socks, comprising relatively small items of apparel are readily overlooked, and inadvertently left interior to washing machines and dryers. Worse, individual socks are often disappeared, likely drawn between the dryer drum and dryer housing during rotation of the drum during drying, or otherwise lost in furnishings, furniture, or around the house in seemingly mysterious ways.

The present invention obviates these and other issues by enabling a convenient means of storing and organizing socks as pairs secured together between a pair of strands of a looped drawstring member, said looped drawstring member depended from an attachment portion that readily secures to an object such as a closet rack, rail, coat hanger, or even door handle, for example. A user may readily remove clean socks for wear and secure dirty socks for laundering by a simple manual action effected to reposition one of a plurality of slidable buckle members. When it's time to launder dirty socks, the entire looped drawstring member, with pairs of dirty socks secured thereto, is removable, portable, and washable as a single unit, whereby socks are maintained together as a single washable, dryable, transportable, and storable unit.

FIELD OF THE INVENTION

The present invention relates to a sock storage and organizing apparatus having an attachment portion releasably securable to an object such as a closet rail, rack, coat hanger, or door handle, for example, from which a depending portion is detachable. The depending portion includes a looped drawstring member disposed to depend under action of gravity from a hook member disposed upon a reverse surface of the attachment portion. The looped drawstring member is threaded through each of a plurality of slidable buckle members securable along the length of said looped drawstring member. Each of the plurality of slidable buckle members is releasably securable along the length of the looped drawstring member by action of a sprung hasp member disposed against the action of a spring member to selectively frictionally engage, and disengage, with the looped drawstring member. Each of a plurality of socks is thus securable between a pair of strands, presented by the looped drawstring member, and associated securement of each of the plurality of slidable buckle members. A stack of pairs of socks is thus securable along the length of the looped drawstring member and moveable as a single unit in conjunction with the depending portion.

Furthermore, a user is enabled sequential wear of socks maintained in order by the present apparatus, and also to secure dirty socks in sequence spaced apart from pairs of clean socks, whereby movement between pairs of socks for wear presents a full load of dirty socks for laundering conveniently as a single unit, which unit presents a stack of organized clean socks for repeated wear after washing and drying.

The present invention thus enables improvements in the arts of storing and laundering personal apparel and presents novel convenience and expedience to a user having ordinary skill in the art.

SUMMARY OF THE INVENTION

The present sock storage and organizing apparatus has been devised to enable a more convenient and expedient means of storing, accessing, porting, and laundering socks, whereby pairs of socks are securable together in bulk, readily transportable when laundering, and dependable from an object such as a closet rail, rack, hanger, or door handle, for example, in a neat and tidy array. Pairs of socks are selectably securable and readily releasable from engagement with the device for wear, as desired. When laundering dirty socks secured by the present apparatus, socks are maintained together and lone socks are thereby prevented from loss by passage into the dryer interior behind the dryer drum, for example, as sometimes occurs, or left inadvertently in the washing machine or dryer, laundry facility or area, or dropped during transport back and forth between a place of storage. Moreover, the present device enables neat and tidy storage of socks and enables alternate use of existing furniture for clothing and apparel more neatly and appropriately storable in drawers.

The present sock storage and organizing apparatus, therefore, includes an attachment portion, attachable to an object such as a closet rail, rack, coat hanger, or door handle, for example, and a depending portion detachably dependable from the attachment portion. A plurality of pairs of socks is selectably securable into the depending portion, and readily and expediently removable therefrom, by a user for wear or storage. Moreover, the present sock storage and organizing apparatus enables interchange of clean and dirty socks in a systematic fashion whereby, once a last clean pair of socks is worn, the depending portion, now filed with dirty socks, is transportable to a laundry facility as a single unit. The depending portion, with dirty socks secured therein, is thence washable by placing in the washing machine. Once washed, the depending portion with socks secured thereto is thence easily removable from the washing machine as one unit prepared for drying. Subsequent drying, the depending portion with socks still attached is thence portable back to a desired storage location (such as a bedroom) with all the pairs of socks now clean and ready for wear, organized upon the depending portion. At no time did any socks necessarily leave the depending portion, a user is enabled to wield the socks through the laundering process as one, conveniently disposed, single unit.

The present sock storage and organizing apparatus, therefore, includes the attachment portion and the depending portion. The attachment portion includes an arcuate inner edge defining an upper boundary of a gap. An elongate portion is disposed endwise connected to the arcuate inner edge, interconnecting said arcuate inner edge and a lowermost portion. In the preferred embodiment herein depicted, the attachment portion is rendered in a shape reminiscent of a human foot. A plurality of toe members is radially projected overtop the arcuate inner edge and the elongate portion is devised to resemble the outer sole of a human foot. The lowermost portion therefore is disposed to resemble a heel of a human foot. The gap, disposed between the arcuate inner edge and the lowermost portion, and bounded on one side by the elongate portion, resembles in negative space the longitudinal arch of a human foot in outline. A user may, therefore, releasably secure the attachment portion by hooking engagement to an object, such as a coat hanger, closet rack or rail, door handle, or another appropriate body or object insertible into the gap, whereby the arcuate inner edge suspends the attachment portion from said object.

The attachment portion includes an obverse side and a reverse side. The obverse side may include design elements presentable to a user using the sock storage and organizing apparatus. A hook member is perpendicularly disposed upon the reverse side at the lowermost portion. The hook member enables depending of the depending portion therefrom, as will be described subsequently.

The depending portion is dependable from the hook member and includes a looped drawstring member and a plurality of slidable buckle members. The looped drawstring member is a looped rope that presents an apex in contact with the hook member when hung therefrom, a pair of strands in parallel relation therebelow, and a nadir terminally disposed distally relative the apex. Each of the pair of strands is threaded through each of the plurality of slidable buckle members. Securable position and reposition of the slidable buckle members along the length of the pair of strands enables securement of pairs of socks between a slidable buckle member and the nadir, and between adjacent buckle members above the nadir. An uppermost slidable buckle member may be securably positioned to secure the apex of the looped drawstring member around the hook member of the attachment portion. Pairs of socks are thus securable stacked between each of the pair of strands of the looped drawstring member and separated by at least one slidable buckle member through which relevant sections of the looped drawstring member are drawn taut to engage around a pair of socks.

Each of the plurality of slidable buckle members includes a discoid body having a pair of apertures transversely disposed therethrough. A sprung hasp member is disposed interior to a circumference circumscribed by the discoid body, and an outfacing depressible portion, disposed upon the sprung hasp member, enables movement of said sprung hasp member against action of a spring member whereby depression of said depressible portion enables each of a pair of appendant apertures, disposed through the sprung hasp member, to align with each of the pair of apertures of the discoid body, whereby each of the pair of strands of the looped drawstring member threaded therethrough is readily moveable through the discoid body and sprung hasp member. Upon release of the depressible portion, action of the spring member forcibly orients the sprung hasp member to forcibly misalign each of the pair of appendant apertures relative each of the pair of apertures in the discoid body, whereby the associated slidable buckle member frictionally engages against the looped drawstring member and maintains position thereupon.

A user may, therefore, position a pair of socks for example between each of the pair of strands at the nadir of the looped drawstring member and thence effect securement of said pair of socks by sliding a lowermost one of the plurality of slidable buckle members to abut said pair of socks, whereby each the pair of strands of the looped drawstring member is drawn taut about the pair of socks. A second pair of socks is thence securable between each of the pair of strands of the looped drawstring member in a position immediately above said lowermost slidable buckle member by securing an adjacently disposed slidable buckle member in appropriate position proximal the lowermost slidable buckle member. This process is repeatable until a plurality of pairs of socks is secured to the drawstring between adjacently disposed slidable buckle members.

A user may, therefore, readily remove a pair of socks for wear by depressing the depressible portion of a relevant slidable buckle member and effect release of a pair of socks from between each of the pair of strands of the looped drawstring member. A pair of dirty socks is thence attachable at the other side of said relevant slidable buckle member, perhaps towards the other end of the looped drawstring member, as desired, whereby a user may wear a pair of socks each day and sequentially move an associated slidable buckle member to release said clean pair of socks and secure a dirty pair. Dirty and clean socks may be thus designated by position upon the drawstring by systematic removal and installation of relevant socks between the apex and the nadir. Once all socks secured the drawstring are dirty, a user unhooks the depending portion from the attachment portion and carries the socks en masse as a conveniently weldable single unit to the laundry facility, as desired.

Thus has been broadly outlined the more important features of the present sock storage and organizing apparatus so that the detailed description thereof that follows may be better understood and in order that the present contribution to the art may be better appreciated.

Objects of the present sock storage and organizing apparatus, along with various novel features that characterize the invention are particularly pointed out in the claims forming a part of this disclosure. For better understanding of the sock storage and organizing apparatus, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
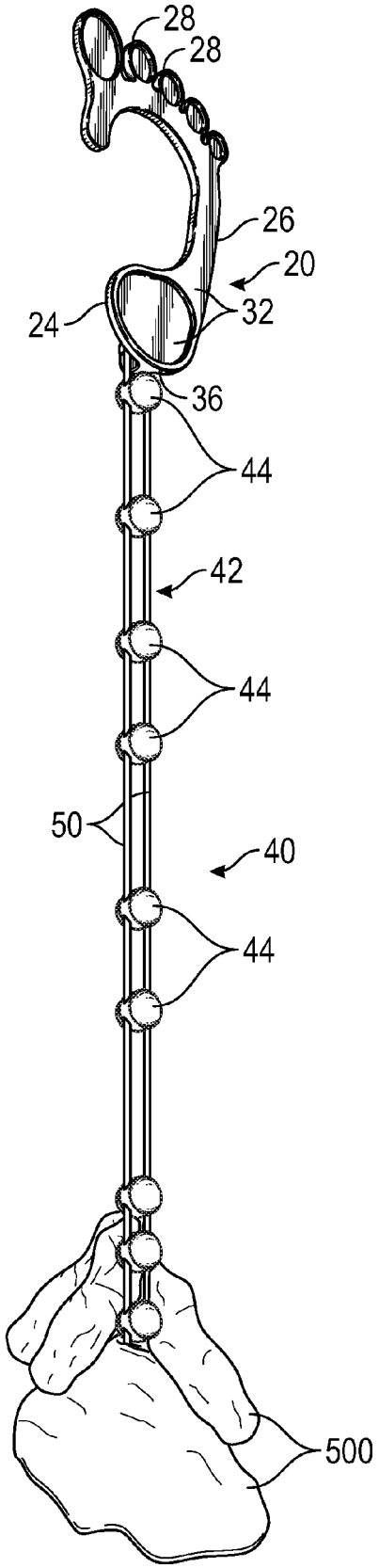
FIG. 1 is an isometric, in-use view of an example embodiment depending from a door handle.
Figure 2:
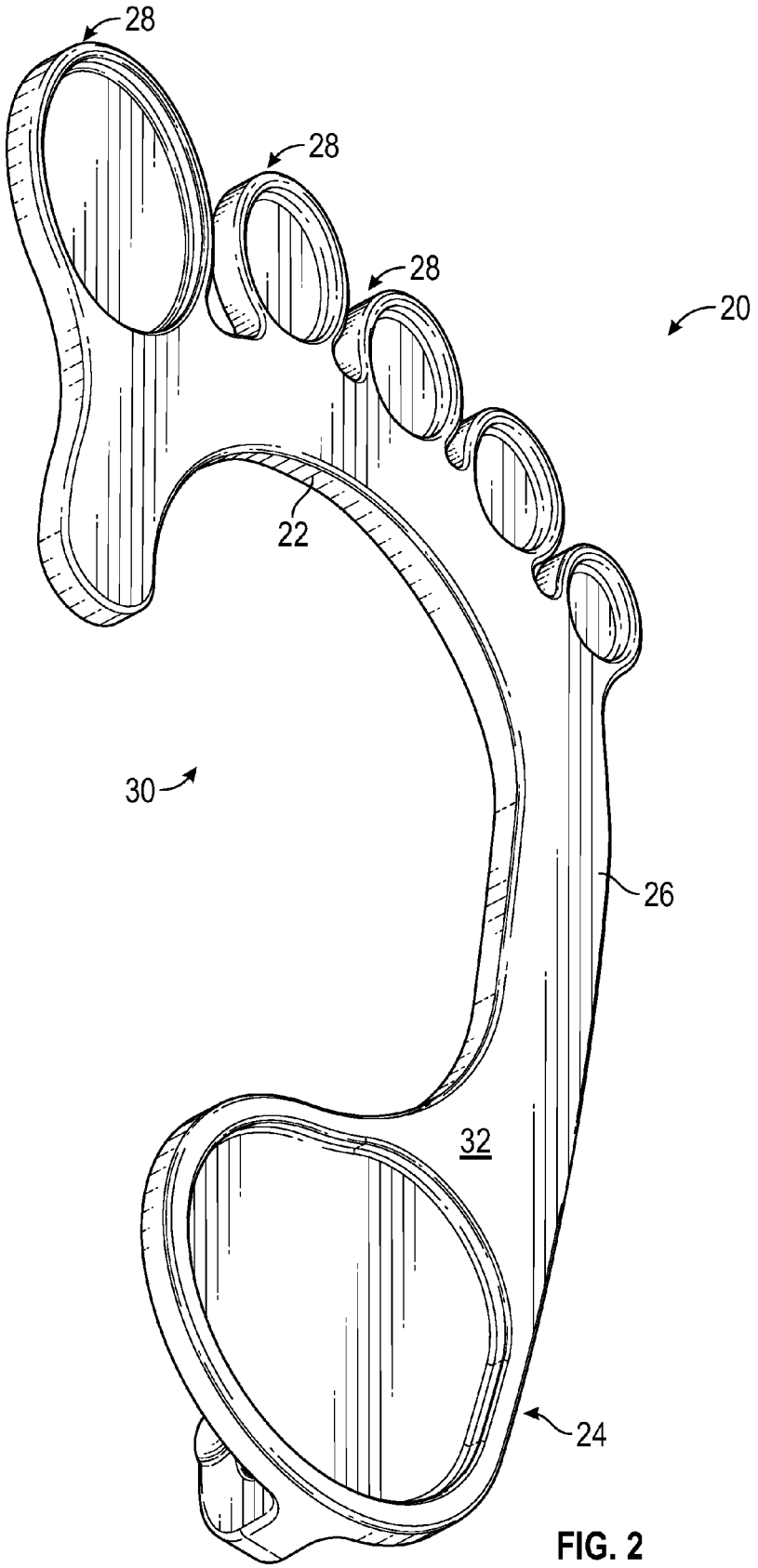
FIG. 2 is an isometric front view of an example embodiment of an attachment portion.
Figure 3:
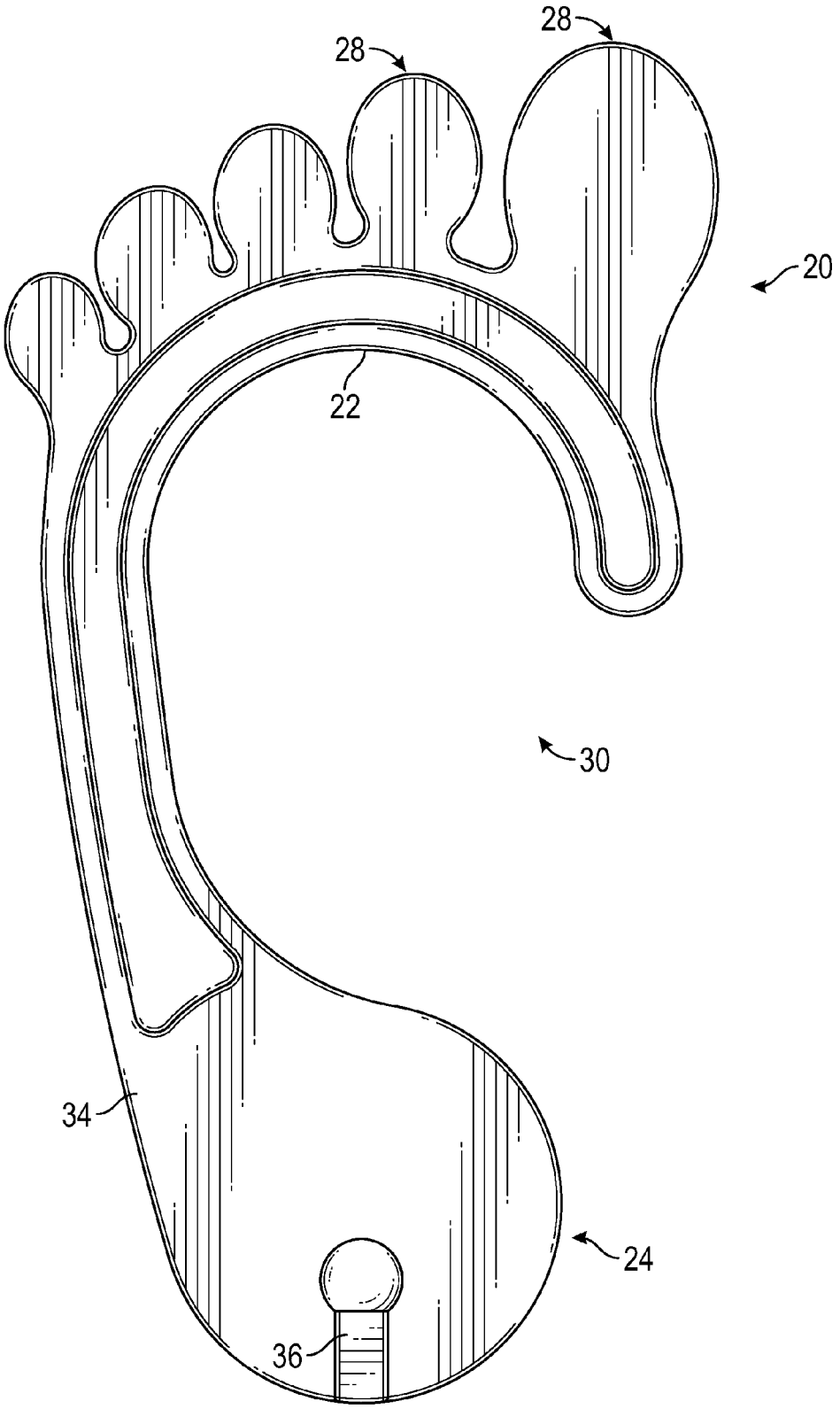
FIG. 3 is a rear view of an example embodiment of the attachment portion.
Figure 4:
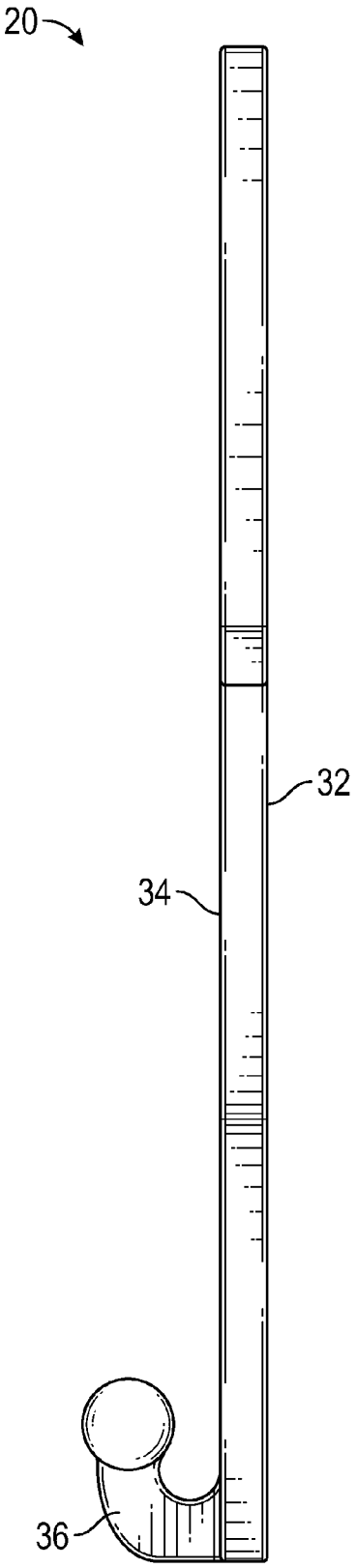
FIG. 4 is a left side view of an example embodiment of the attachment portion.
Figure 5:
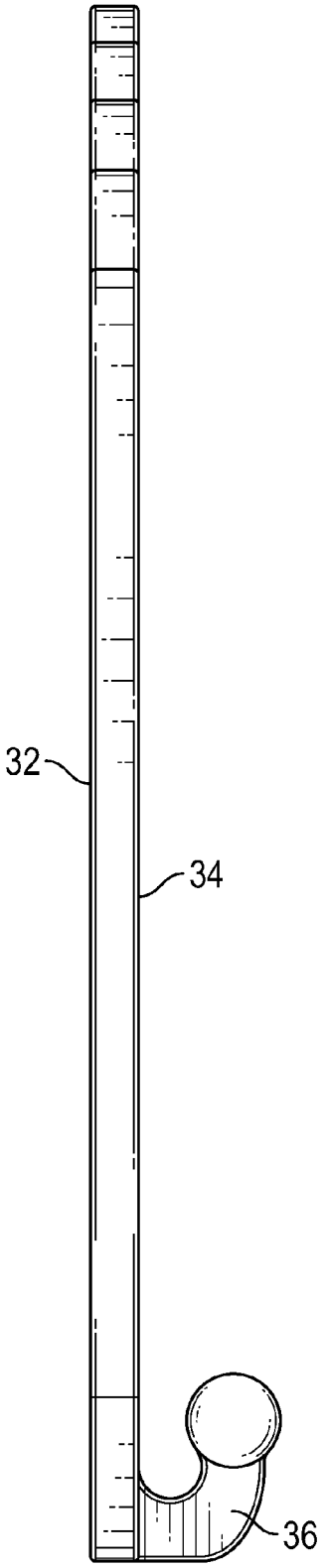
FIG. 5 is a right side view of an example embodiment of the attachment portion.
Figure 6:
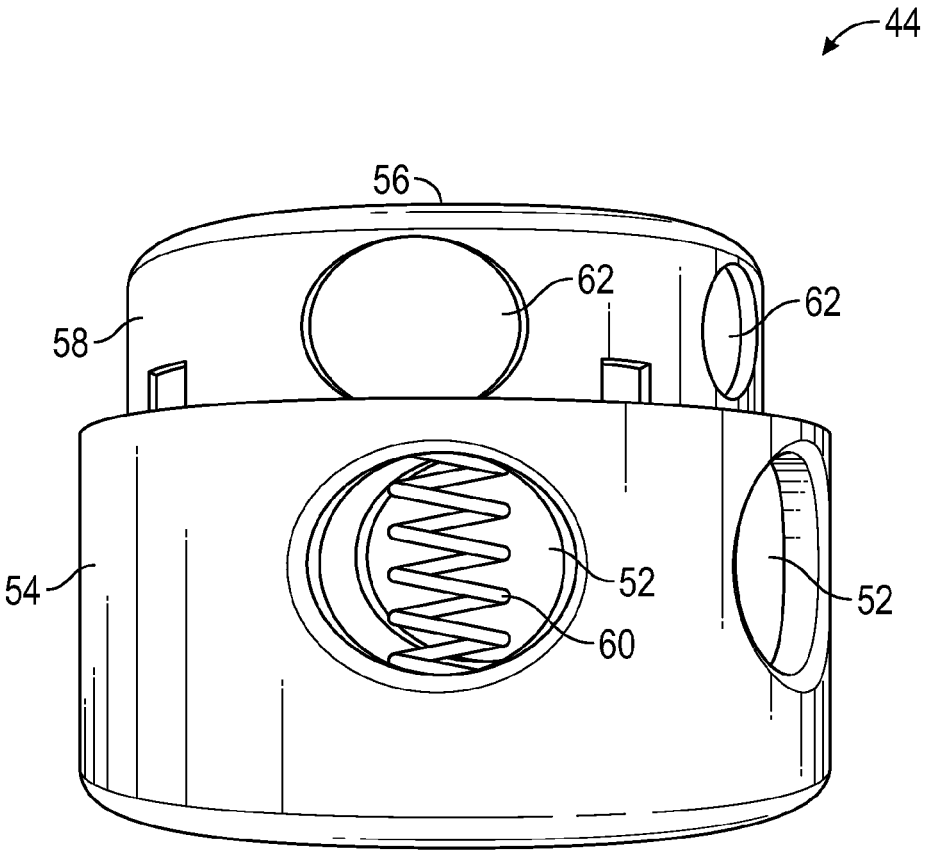
FIG. 6 is a detail view of an example embodiment of one of a plurality of slidable buckle members removed from a looped drawstring member of a depending portion.

With reference now to the drawings, and in particular FIGS. 1 through 7 thereof, example of the instant sock storage and organizing apparatus employing the principles and concepts of the present sock storage and organizing apparatus and generally designated by the reference number 10 will be described.

Referring to FIGS. 1 through 7 a preferred embodiment of the present sock storage and organizing apparatus 10 is illustrated.

The present sock storage and organizing apparatus 10 has been devised to enable convenient storage and access to pairs of socks by providing an expedient means of securing pairs of socks to a looped drawstring member 42 that is dependable from an attachment potion 20 and releasably securable to an object, such as a closet rail, rack, hanger, or door handle. Additionally, the present sock storage and organizing apparatus 10 enables convenience when laundering socks as the looped drawstring member 42 is readily removable from the attachment portion 20 and may be included in a load of laundry with a plurality of pairs of socks attached thereto. Loss of socks in the laundry, during washing and drying for example, is thereby controllable as socks are secured together and clumped in such a way as to prevent individual socks from being pulled behind the dryer drum, for example, as often happens over repeated washing and drying cycles.

The present sock storage and organizing apparatus 10, therefore, includes an attachment portion 20. An arcuate inner edge 22 is disposed for hooking engagement around an object, such as to a closet rail, rack, hanger, or a door handle, for example, and a lowermost portion 24 depends a depending portion 40 for selective engagement with a plurality of socks 500, as will be described subsequently.

In the preferred embodiment disclosed in the accompanying Figures, the attachment portion 20 is rendered in the shape of a human foot. The attachment portion 20 includes a lowermost portion 24; in the preferred embodiment herein disclosed the lowermost portion 24 is shaped like the heel of a human foot. The attachment portion 20 thus incorporates the general shape of a human foot, wherein the outer sole (including at least a portion of the lateral longitudinal arch, the lateral plantar, and sural of the foot) is suggested by an elongate portion 26 uniting the arcuate inner edge 22 and the lowermost portion 24. Five toe members 28 are projected radially upwards overtop the arcuate inner edge 22, there reminiscent of human toes. A gap 30, reminiscent of the arched portion of a human foot, disposed between the arcuate inner edge 22 and the lowermost portion 24, and bounded on one side by the elongate portion 26, enables hooking engagement of the attachment portion 20 to an object.

The attachment portion 20 includes an obverse surface 32 disposed upon one side of the attachment portion 20 and a reverse surface 34 disposed upon the other side of the attachment portion 20. A hook member 36 is disposed perpendicularly upon the reverse surface 34 at the lowermost portion 20 from whence a depending portion 40 is releasably depended (see FIGS. 3, 4 and 5). The depending portion 40 includes a looped drawstring member 42, disposed for hanging engagement upon the hook member 36, and a plurality of slidable buckle members 44 selectively securable along the length of the looped drawstring member 42 (see FIG. 1).

In an example embodiment set forth herein, the looped drawstring member 42 is devised of paracord, essentially comprising a lightweight nylon kernmantle rope disposed in the form of a loop. The looped drawstring member 42 thus incorporates an inner core (not shown) of synthetic fibers within an exterior sheath of synthetic fibers, such as nylon, for example. The looped drawstring member 42 is thereby composed of impermeable fibers (but may admit water in between said fibers, through the weave of said fibers) and devised to be heat resistant at temperatures frequently applied when drying clothes and apparel in the home.

Figure 7:
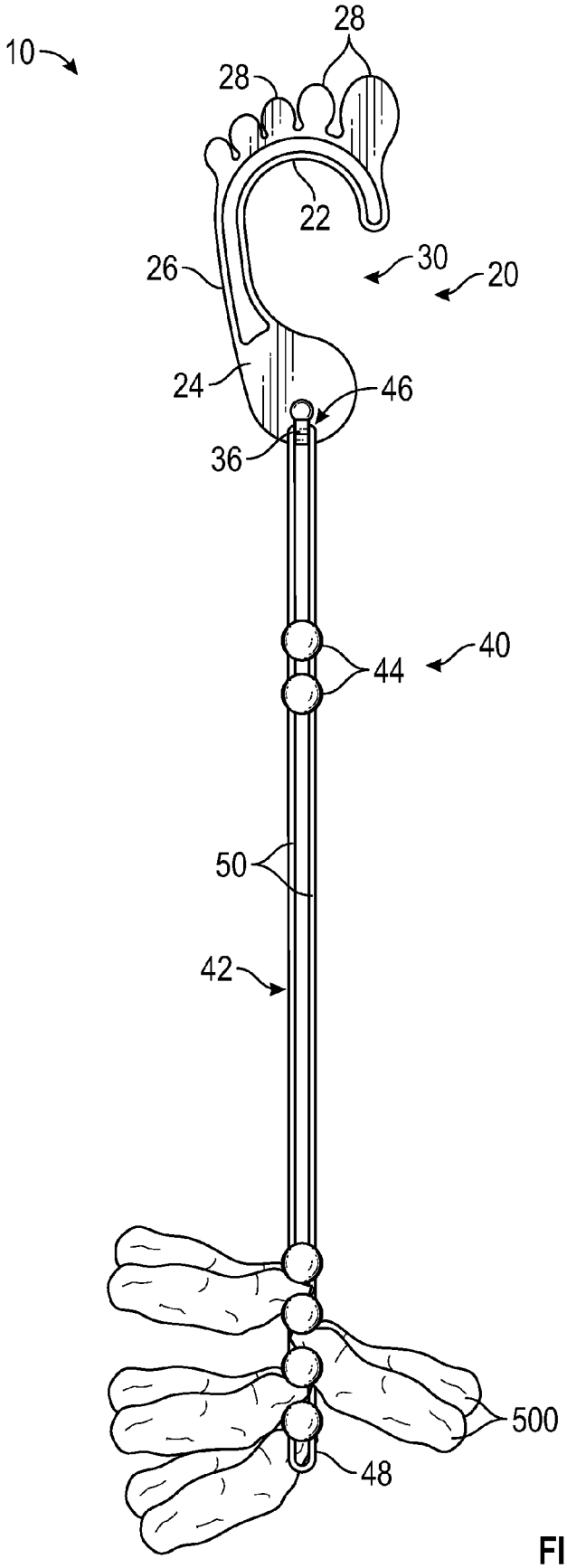
FIG. 7 is a rear, in use view of an example embodiment.

The looped drawstring member 42 thus presents an apex 46 at contact with the hook member 36, a nadir 48 distally delimited therefrom, and a pair of strands 50 in parallel when the looped drawstring member 42 is depended from the hook member 36 (see FIG. 7). Each of the pair of strands 50 is threaded through each of a pair of apertures 52 disposed in each of the plurality of slidable buckle members 44 whereby each of the plurality of slidable buckle members 44 is securably repositionable along the length of the pair of strands 50, and said pair of strands 50 of the looped drawstring member 42 is maintained in parallel relation between the apex 46 and the nadir 48.

Each of the plurality of slidable buckle members 44 includes a discoid body 54. The pair of apertures 52 is disposed in parallel relation through the discoid body 54, each of said pair of apertures 52 disposed on either side of a diameter of said discoid body 54. A depressible portion 56 is disposed outfacing within the circumference of the discoid body 54 and conjoined with a sprung hasp member 58, likewise disposed interior to the discoid body 54. The sprung hasp member 58 is disposed against the action of a spring member 60 to frictionally engage against the looped drawstring member 42 until the depressible portion 56 is depressed (see FIG. 6).

The sprung hasp member 58 of each of the plurality of slidable buckle members 44 includes a pair of appendant apertures 62 through which the looped drawstring member 42 is also threaded. This pair of appendant apertures 62 is disposed to align with the pair of apertures 52 of the associated discoid body 54 when the depressible portion 56 is depressed, and thereby misalign therewith when the depressible portion 56 is released. Action of the spring member 60, disposed in tension against the sprung hasp member 58, maintains misalignment of the pair of appendant apertures 62 in relation to the pair of apertures 52 in the discoid body 54 absent contrary force applied to the depressible portion 56.

Each of the plurality of slidable buckle members 44 is therefore slidable upon the looped drawstring member 42 when each corresponding depressible portion 56 is depressed, and each of the plurality of slidable buckle members 44 engages the looped drawstring member 42 when each corresponding depressible portion 56 is released, whereby a user is enabled slidable reposition of each of the plurality of slidable buckle members 44 along the length of the looped drawstring member 42 to selectively engage against an item of apparel 500 maintained between one of the plurality of slidable buckle members 44 and each of the pair of strands at the nadir 48 of the looped drawstring member 42, or engaged between each of the pair of strands by at least two adjacently disposed ones of the plurality of slidable buckle members 44 when positioned above the nadir 48.

What is claimed is:

1. A sock storage and organizing apparatus comprising:

an attachment portion having:

an arcuate inner edge disposed for hooking engagement around an object;

a lowermost portion;

an obverse surface disposed upon one side of the attachment portion;

a reverse surface disposed upon the other side of the attachment portion;

a hook member perpendicularly disposed upon the reverse surface at the lowermost portion; and a depending portion comprising:

a looped drawstring member disposed for hanging engagement upon the hook member, said looped drawstring member presenting each of a pair of strands when depended from the hook member, an apex at contact with the hook member, and a nadir distally delimited therefrom;

a plurality of slidable buckle members, each of said plurality of slidable buckle member comprising:

a discoid body;

a pair of apertures disposed in parallel relation transversely through the discoid body;

a depressible portion; and a sprung hasp member disposed interior to the discoid body in operational communication with the depressible outer portion, said sprung hasp member disposed against the action of a spring member to frictionally engage against each of the pair of strands of the looped drawstring member until the depressible portion is depressed;

wherein each of the plurality of slidable buckle members is slidable upon the looped drawstring member when each corresponding depressible portion is depressed, and each of the plurality of slidable buckle members frictionally engages the looped drawstring member when each corresponding depressible portion is released, whereby a user is enabled to slidably reposition each of the plurality of slidable buckle members along the length of the looped drawstring member to selectively engage against an item of apparel maintained between each of the pair of strands of the looped drawstring member and at least one of the plurality of slidable buckle members at the nadir, and at least two of the plurality of slidable buckle members above the nadir.

2. The sock storage and organizing apparatus of claim 1 wherein each sprung hasp member further comprises a pair of appendant apertures through which the pair of strands of the looped drawstring is threaded, wherein said spring hasp member is moveable between a depressed position, and each of the pair of appendant apertures is aligned with each of the pair of apertures disposed in the discoid body, and a sprung position, wherein each of the pair of appendant apertures is misaligned with each of the pair of apertures disposed in the discoid body, whereby misalignment of the pair of appendant apertures with the pair of apertures frictionally engages the drawstring member therebewteen.

3. The sock storage and organizing apparatus of claim 2 wherein the spring member is galvanized metal.

4. The sock storage and organizing apparatus of claim 2 wherein the attachment portion is shaped to resemble a human foot.

5. The sock storage and organizing apparatus of claim 2 wherein the spring member is made of copper.

6. The sock storage and organizing apparatus of claim 4 wherein the attachment portion further comprises five toe members reminiscent of human toes projected radially outward over top of the arcuate inner edge.

7. The sock storage and organizing apparatus of claim 6 wherein the attachment portion further comprises an elongate portion disposed between the arcuate inner edge and the lowermost portion, said elongate portion disposed to resemble at least a portion of an outer sole of a human foot.

8. The sock storage and organizing apparatus of claim 7 wherein the lowermost portion of the attachment portion is disposed to resemble a heel of a human foot.

9. A sock storage and organizing apparatus comprising:

an attachment portion disposed to resemble a human foot, said attachment portion comprising:

an arcuate inner edge disposed for hooking engagement around an object;

a plurality of toe members, reminiscent of human toes, disposed radially projected overtop of the arcuate inner edge;

an elongate portion disposed longitudinally from the arcuate inner edge, said elongate portion reminiscent of at least portions of an outer sole of a human foot;

a lowermost portion disposed terminally connected endwise to the elongate portion, said lowermost portion disposed to resemble a heel of a human foot;

an obverse surface disposed upon one side of the attachment portion;

a reverse surface disposed upon the other side of the attachment portion;

a hook member perpendicularly disposed upon the reverse surface at the lowermost portion; and a depending portion comprising:

a looped drawstring member disposed for hanging engagement upon the hook member, said looped drawstring presenting each of a pair of strands when depended from the hook member, an apex at contact with the hook member, and a nadir distally delimited therefrom;

a plurality of slidable buckle members through which each of the pair of strands of the looped drawstring member is strung, each of said plurality of slidable buckle members comprising:

a discoid body;

a pair of apertures disposed in parallel relation transversely through the discoid body, each of said pair of apertures disposed on either side of a diameter of said discoid body;

a depressible portion disposed outfacing from within a circumference of the discoid body; and a sprung hasp member conjoined to the depressible portion and disposed interior to the discoid body against the action of a spring member, said sprung hasp member having a pair of appendant apertures disposed to align with the pair of apertures in the discoid body when the depressible portion is depressed and misalign therewith when the depressible portion is released;

wherein each of the plurality of slidable buckle members is slidable upon the looped drawstring member when each corresponding depressible portion is depressed, and each of the plurality of slidable buckle members frictionally engages the looped drawstring member when each corresponding depressible portion is released, whereby a user is to slidably reposition each of the plurality of slidable buckle members along the length of the looped drawstring member to selectively engage against an item of apparel maintained between each of the pair of strands of the looped drawstring member and at least one of the plurality of slidable buckle members at the nadir, and at least two of the plurality of slidable buckle members above the nadir.

* * * * *